United States Patent [19]

Le Diouron

[11] 4,090,369

[45] May 23, 1978

[54] METHOD AND AN INSTALLATION FOR THE REFRIGERATION BY DISCONTINUOUS CHARGES OF OBJECTS IN BULK

[75] Inventor: Raymond J. F. Le Diouron, Grenoble, France

[73] Assignee: L'Air Liquide, Societe Anonyme pour l'Etude et l'Exploitation des Procedes Georges Claude, Paris, France

[21] Appl. No.: 694,466

[22] Filed: Jun. 9, 1976

[30] Foreign Application Priority Data

Jun. 12, 1975 France ..... 75 18341

[51] Int. Cl.[2] ..... F25D 13/06

[52] U.S. Cl. ..... 62/63; 62/208; 62/380

[58] Field of Search ..... 62/62, 63, 65, 208, 62/223, 380

[56] References Cited

U.S. PATENT DOCUMENTS

| | | | |
|---|---|---|---|
| 2,015,167 | 9/1935 | Varney | 62/63 |
| 2,059,970 | 11/1936 | Robillard | 62/63 |
| 3,412,573 | 11/1968 | Pauliukonis | 62/63 |
| 3,413,818 | 12/1968 | Pelmulder | 62/63 |
| 3,427,820 | 2/1969 | Hart | 62/65 |

*Primary Examiner*—Ronald C. Capossela
*Attorney, Agent, or Firm*—Young & Thompson

[57] ABSTRACT

The invention relates to a method and an installation for the refrigeration by discontinuous charges of objects in bulk which occupy a long thermally-insulated zone, the method comprising essentially the steps of: carrying out the complete refrigeration of the objects located in a longitudinally-restricted portion of the thermally-insulated zone by circulating a main flow of cooling gas longitudinally inside the restricted portion, partly re-cycling the cooling gas outside the thermally-insulated zone to an injection station for frigorific energy such as refrigerated gas in the liquid or solid state, precooling the objects located in a remaining portion of the insulated zone by the longitudinal circulation of an excess flow of non-re-cycled cooling gas through the remaining portion followed by evacuation to the atmosphere, circulating all the main flow of cooling gas longitudinally through the remaining portion of the insulated zone, and re-cycling an excess flow of said cooling gas outside said zone to the frigorific energy injection station with subsequent direct evacuation to the atmosphere.

The operations take place in two stages, the duration of the first stage being such that the cooling gas temperatures at the inlet and outlet of the restricted portion are substantially equal, the duration of the second stage being such that the cooling gas temperatures at the inlet and outlet of the remaining portion of the insulated zone are substantially the same.

Application to the cryogenic fragilization of objects for their grinding or separation.

6 Claims, 3 Drawing Figures

METHOD AND AN INSTALLATION FOR THE REFRIGERATION BY DISCONTINUOUS CHARGES OF OBJECTS IN BULK

The present invention relates to the refrigeration of objects in bulk by discontinuous charges, occupying the whole of an elongated zone of thermal insulation.

It has already been proposed to establish a circulation of cooling gas on the one hand in the interior of a longitudinally-restricted portion of the said elongated zone of thermal insulation, with re-cycling of a fixed flowrate of cooling gas by passing on the outside of the said thermal insulation zone in front of an injection station for additional liquefied gas, and evacuation of a possible excess flow-rate of cooling gas longitudinally through a remaining portion of the said thermal insulation zone, towards one extremity of this latter.

Thus, it is possible to ensure complete cooling to the desired temperature of objects in bulk located in the restricted portion of the thermal insulation zone, while the objects located in the remaining portion of this thermal insulation zone are pre-cooled during this same period of time.

When the objects in bulk in the restricted portion of the thermal insulation zone have reached the desired cooling temperature, the said refrigeration zone is emptied only of the objects in bulk located in the said restricted portion, while at the same time the objects located in the remaining or pre-cooling portion are displaced from the thermal insulation zone towards the restricted portion of this same zone, with introduction of objects in bulk at the warm temperature, for example at the ambient temperature, into the said remaining portion of the thermal insulation zone thus freed, so as thereby to recommence a cycle of refrigeration to the desired temperature of the objects located in the restricted portion of the thermal insulation zone.

This method of operation makes it possible to ensure a very good thermal efficiency but on the other hand, a relatively bad utilization of the thermal insulation zone, since the volume of this zone is only partially utilized, that is to say solely as regards the restricted portion of the thermal insulation. On the other hand, it is desirable to have available reliable means for evacuating from the refrigeration zone solely the products in bulk initially placed in the restricted portion of this zone.

In the case where the objects in bulk are displaced by gravity in a refrigeration zone delimited by a refrigeration tunnel, this condition results in complex closure means for the lower door of the said refrigeration tunnel.

The present invention has for its object a method and a refrigeration installation which avoid the drawbacks above-mentioned, by virtue of the cooling of the whole of the objects in bulk located in the cooling zone, while at the same time achieving a thermal balance which is acceptable in this type of application.

According to the invention, in a method of cooling of objects in bulk, by discontinuous charges occupying the whole of a thermal elongated insulation zone, of the kind in which there is carried out in a first stage, on the one hand a complete cooling of the objects located in a longitudinally-restricted portion of the thermal insulation zone by circulation of a main flow of cooling gas longitudinally in the interior of the said restricted portion, the said cooling gas being at least partly re-cycled outside the said cooling zone towards an injection station for frigorific energy, especially for refrigerated gas, and on the other hand a pre-cooling of the objects located in a remaining portion of the said thermal insulation zone by circulation longitudinally in the said remaining portion followed by evacuation to the atmosphere of an excess flow of non-re-cycled cooling gas; in a second stage, the whole of the main flow of cooling gas is caused to circulate into the said remaining portion of the thermal insulation zone which is also re-cycled outside the said thermal insulation zone towards the said injection station for frigorific energy with direct evacuation into the atmosphere of an excess flow of cooling gas.

In this way, during the first stage, it is possible to ensure the cooling of a substantial part of the objects in bulk, that is to say of those placed in the longitudinally-restricted portion of the cooling zone, while taking advantage of a pre-cooling of the objects located in the remaining portion of the cooling zone, whereas, in the second stage, which can affect a much smaller part of the objects in bulk, this possibility of recovery of heat by pre-cooling cannot be obtained. In spite of this and by judiciously dimensioning the volumes of the restricted and remaining portions of the cooling zones, it is possible to ensure an overall heat balance which is entirely satisfactory.

The invention has also for its object a cooling installation which carries the above method into effect.

The characteristic features and advantages of the invention will furthermore be brought out in the description which follows below by way of example, reference being made to the accompanying drawings, in which.

Figure 1:
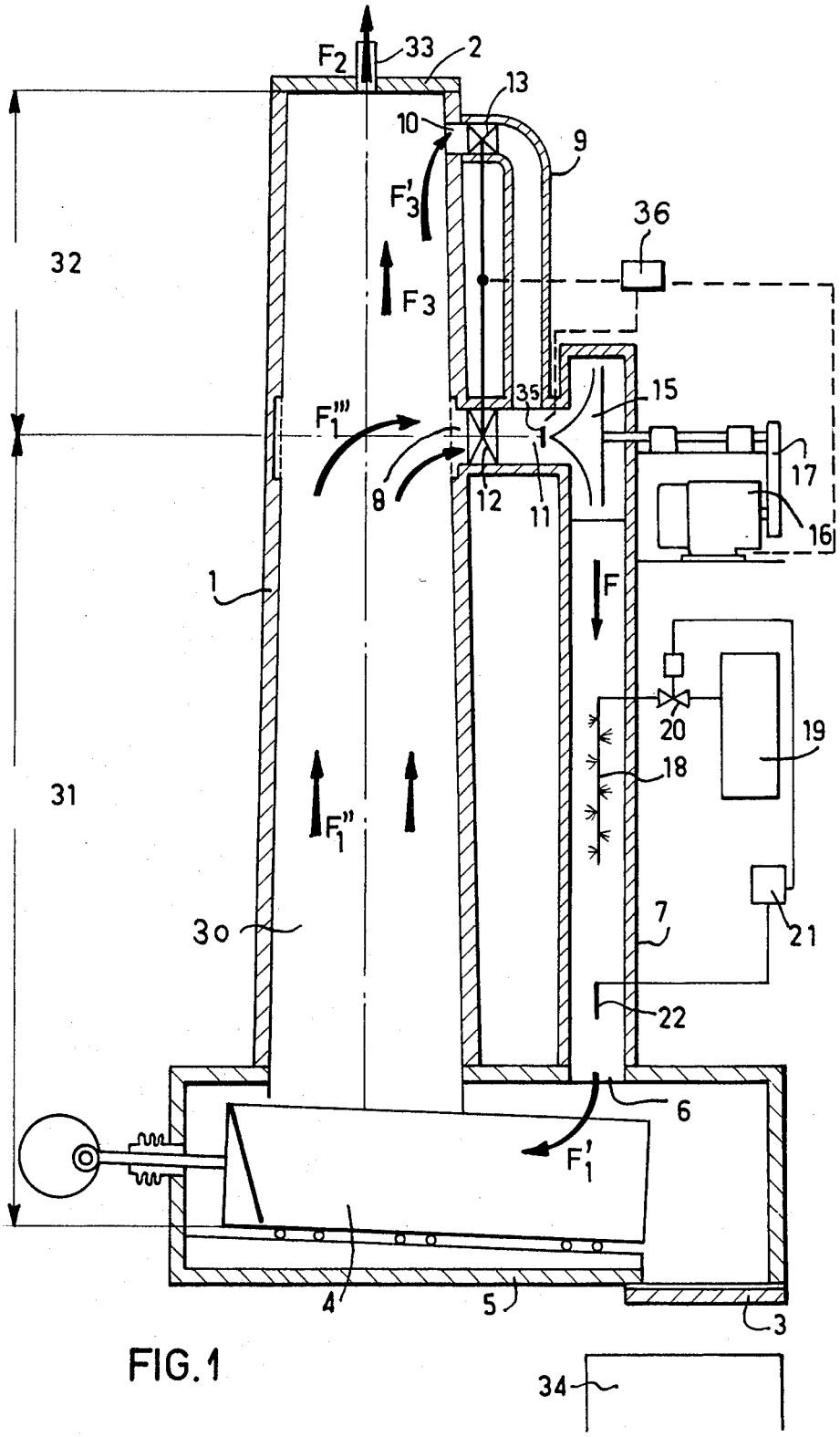
FIG. 1 is a diagrammatic view in vertical section of a cooling installation in accordance with the invention.

Referring now to FIG. 1, it is seen that a cooling installation comprises a refrigeration tunnel 1 with a vertical axis, comprising an upper loading door 2 and a lower unloading door 3, facing an evacuation device 4 placed in a lower horizontal portion 5 of the tunnel 1 at the level of the unloading door 3.

The refrigeration tunnel 1 comprises a first end orifice 6 opening into a main re-cycling conduit 7, coupled to a central orifice 8 placed in a position intermediate between the end doors 2 and 3. An auxiliary re-cycling conduit 9 extends between a second end orifice 10 and a portion 11 of the main re-cycling conduit 7. Valves 12 and 13 are respectively placed in the main re-cycling conduit 7 between the portion 11 and the central orifice 8, and in the auxiliary re-cycling conduit. The main re-cycling conduit incorporates a fan 15 actuated by a motor 16 through a belt 17, this fan acting in such manner as to propel the gas in the direction of the arrow F in the main re-cycling conduit 7, that is to say in the direction of the first end orifice 6.

Downstream of the fan 15 is arranged a spraying device 18 fed from a tank 19 of cryogenic liquid through the intermediary of a valve 20 subjected to a thermostatic control device 21 equipped with a thermostatic probe 22, placed downstream of the spraying device 18, while on the upstream side of the fan 15 is provided a thermostatic probe 35 intended to ensure the reversal of the valves 12, 13 on the one hand through the intermediary of a regulator 36, and later on the other hand to effect the stopping of the fan motor 16 when a refrigeration temperature has been reached. In passing, it will be noted that the stopping of the motor 16 stops the spraying action in the device 18 if this latter is in a condition for operation.

The arrangement which has just been described defines an elongated cooling zone 30 which is constituted by the whole of the refrigeration tunnel 1, this cooling zone 30 being divided longitudinally into a so-called restricted zone 31 between the end door 3 and the transverse plane at the level of the central orifice 8 on the one hand, and a so-called remaining zone 32 between this same plane of the central orifice 8 and the introduction door 2.

In operation, objects in bulk at a warm temperature, for example at the ambient temperature, are poured into the refrigeration tunnel in which they are piled until they occupy the whole of the internal volume of this refrigeration tunnel 1, after which the fan 15 is started-up at the same time as the spraying device 18 which sprays liquid nitrogen, for example.

During the course of a first stage, the valve 12 is open while the valve 13 is closed. It follows that the gas re-cycling circuit is established through the zone 31 only (arrows $F'_1 F''_1 F'''_1$) towards the central orifice 8 of the main re-cycling circuit 7 (arrow F) and through the first end orifice 6.

During this time, an excess flow of gas formed during the periods of operation of the spraying device 18 escapes at $F_2$ through an orifice 33 in the inlet door 2. It is found that this arrangement makes it possible to cause the coldest gases to pass through the restricted zone 31, while the excess gases pass through the remaining zone 32, known as the pre-cooling zone, and are heated before escaping to free air.

When once the temperature of the gases passing out of the restricted zone 31, that is to say the temperature taken by the probe 35, becomes practically the same as the initial temperature of the coldest gases engaged in the main re-cycling conduit 7, the automatic device 36 permits the switching over of the valves 12 and 13, the valve 13 being opened and the valve 12 closed. The circuit of the cooling gases then passes not only through the restricted zone 31, but also in the direction of the arrow $F_3$, $F'_3$, through the remaining portion 32 of the cooling zone 30' the gas being re-cycled through the auxiliary re-cycling conduit 9 and then through the main re-cycling conduit 7, in such manner as to utilize the circulation and spraying equipment 18.

On the contrary to what takes place during the course of the first stage, the excess gas during the course of this second stage is directly freed to the atmosphere at 33 at a temperature which becomes gradually lower. As soon as the temperature of the refrigeration gases taken at the level of the probe 35 is such that these gases have not been heated, as compared with the temperature of the probe 22, the gas circulation system 15, and when so applicable the liquified gas spraying device 18, is put out of operation by the device 36 and the complete charge of objects in bulk located in the refrigeration tunnel 1 can be discharged through the outlet door 3 by actuating the unloading device 4 towards a crushing or grinding machine 34.

When once the tunnel is completely emptied, the outlet door 3 is closed, the unloading device 4 is stopped, and other objects at a warm temprature, for example at the ambient temperature, are introduced into the upper extremity of the tunnel through the door 2.

Figure 3:
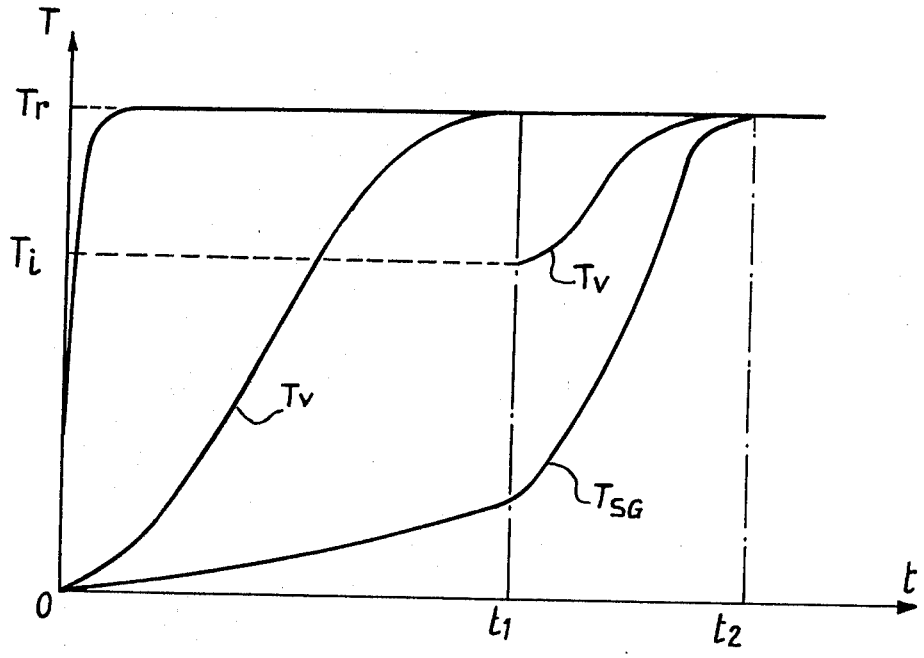
FIG. 3 is a diagram showing the falls in temperature as a function of time.

If reference is made to FIG. 3, it is seen that there have been shown along the ordinates the temperature T and along the abscissae the time *t*. The ambient temperature corresponds to O, while the coldest temperature of the cooling gas corresponds to the temperature Tr. During a first stage which continues up to the time t1, it is seen that the temperature of the cooling gas at the inlet of the fan is shown at Tv. At the time t1, as previously indicated, the switching over of the valves 12 and 13 is effected, and it will then be understood that the temperature of the gas at the inlet of the fan rises to the temperature Ti and gradually again falls to the temperature Tr during the second stage of operation which extends from the time *t*1 to the time *t*2.

During all this period, which covers the time up to the time *t*2, there has been shown at Tsg the curve of outlet temperature of the gases through the orifice 33 of the inlet door 2, and it is seen that in the first stage (between O and *t*1) the temperature of the outgoing gases is only slightly less than the ambient temperature, and more precisely starts at ambient temperature and goes to a moderately cold temperature, whereas as soon as the change-over of the valves is effected during the second stage extending from the time *t*1 to the time *t*2, this outlet temperature of the warm gases falls rapidly and terminates at the final refrigeration temperature. The whole of the products in bulk is then cooled down to the desired temperature.

Figure 2:
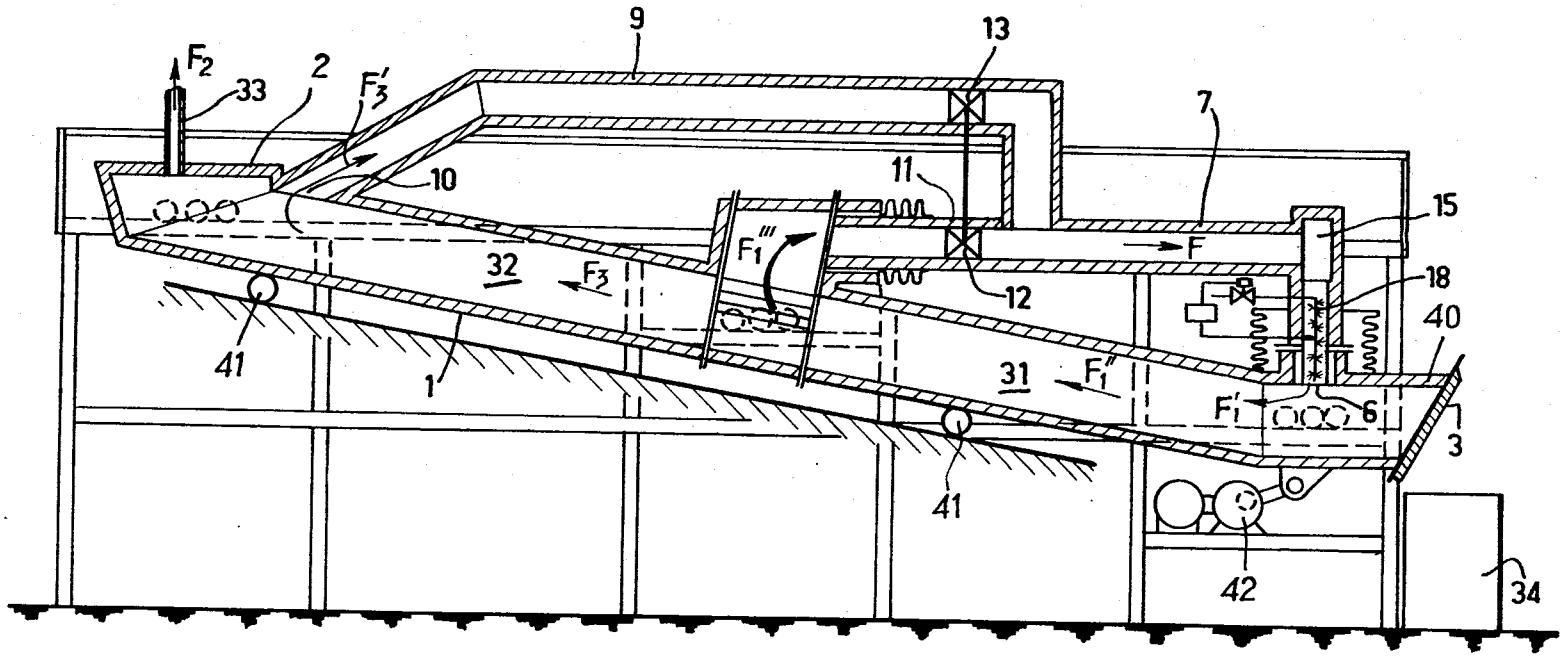
FIG. 2 is a view similar to FIG. 1 and relates to an alternative form of embodiment.

Referring now to FIG. 2, there is again seen a refrigeration tunnel which utilizes certain parts of the tunnel shown in FIG. 1, and these common elements have been given the same reference numbers. On the contrary to FIG. 1, the tunnel 1 has not in this case a vertical axis but is very considerably inclined to the vertical with an angle of inclination of the order of 30° to the horizontal, while it terminates at the downstream extremity in a horizontal portion 40 provided with an unloading door 3.

The whole of the tunnel is mounted on rolling tracks 41 and is associated with a system of alternating vibration 42. This tunnel is particularly suitable for the cooling of objects in bulk having relatively high density and volume, for example electric motors or transformers for which the loading into a vertical tunnel would be liable to cause shocks at the beginning of loading which might damage the walls of the refrigeration tunnel.

The invention is applicable to the cooling of objects so as to harden them or to make them fragile for grinding purposes.

The tunnel described may also be fed with liquid $CO_2$ stored at −20° C. under a pressure of 20 bars. Only the supply system for refrigerant fluid requires to be modified. Cooling by $CO_2$ is utilized for treating products for which the fragility temperature is relatively low (fragility temperature equal to or lower than −60° C.); for example: zamak, products with a base of rubber and PVC.

$CO_2$ can also be considered for the pre-cooling of a charge down to −40° or −60° C., cooling to lower temperatures than this being effected by liquid nitrogen.

The cooling of the charge in the tunnel may be carried out in two stages:

Pre-cooling of the charge from the ambient temperature down to a temperature comprised between −20° and −60° C., either by a mechanical refrigerating apparatus; or by $CO_2$ or any refrigerant fluid other than liquid nitrogen;

Cooling to the fragility temperature by liquid nitrogen.

The advantage of this latter method is that it limits the consumption of liquid nitrogen, the pre-cooling of the product being ensured with an expenditure of frigories less than the cost of the frigories produced by liquid nitrogen.

What I claim is:

1. A refrigeration installation comprising a thermally-insulated refrigeration tunnel, a first end orifice located at one extremity of said tunnel and a central orifice located at an intermediate position of said tunnel, a main recycling conduit incorporating gas-circulation means and injection means for liquefied gas, and further comprising a second end orifice at the other extremity of said refrigeration tunnel and an auxiliary recycling conduit connecting said second end orifice to said main recycling conduit at a connection point on the upstream side of said gas-circulation means, a first valve arranged directly in said auxiliary recycling conduit between said connection point and said second end orifice, and a second valve between said connection point and said central orifice.

2. A refrigeration installation as claimed in claim 1, in which said refrigeration tunnel comprises a main portion inclined to the horizontal in such manner as to ensure the transfer of said objects in bulk from a second extremity of the conduit forming the introduction orifice to a first extremity of the tunnel forming an unloading orifice.

3. A refrigeration installation as claimed in claim 2, in which the inclined portion of said refrigeration tunnel is mounted so as to be capable of longitudinal oscillation, and in which said refrigeration tunnel is associated with alternating displacement means acting along that axis.

4. A method of refrigeration by discontinuous charges of objects in bulk occupying the whole of an elongated thermally insulated zone, said zone comprising a precooling portion occupying one end of said zone and a final cooling portion occupying the other end of said zone, said method being comprised by a first stage followed by a second stage, said first stage comprising the steps of circulating a cooling gas through said final cooling portion, recycling a portion of said cooling gas through said final cooling portion, passing the remainder of said cooling gas through said precooling portion and thereafter evacuating to the atmosphere said remainder of said cooling gas, until the temperature of said cooling gas remains substantially the same throughout said final cooling portion; said second stage comprising the steps of circulating all said cooling gas through said final cooling portion and said precooling portion, recycling a portion of said cooling gas through said final cooling portion and precooling portion, and evacuating to the atmosphere the remainder of said cooling gas.

5. The method as claimed in claim 4, in which said second stage is conducted until the temperature of said cooling gas remains substantially the same throughout said precooling portion.

6. Apparatus for refrigeration by discontinuous charges of objects in bulk occupying the whole of an elongated thermally insulated tunnel, said tunnel comprising a precooling portion occupying one end of said tunnel and a final cooling portion occupying the other end of said tunnel, said apparatus being adapted to effect said refrigeration in a first stage followed by a second stage, and for said first stage comprising means for circulating a cooling gas through said final cooling portion, means for recycling a portion of said cooling gas through said final cooling portion, means for passing the remainder of said cooling gas through said precooling portion and thereafter evacuating to the atmosphere said remainder of said cooling gas, until the temperature of said cooling gas remains substantially the same throughout said final cooling portion; said apparatus for said second stage comprising means for circulating all said cooling gas through said final cooling portion and said precooling portion, means for recycling a portion of said cooling gas through said final cooling portion and precooling portion, and said means for evacuating to the atmosphere the remainder of said cooling gas.

* * * * *